United States Patent [19]

Nelson

[11] Patent Number: 4,739,777

[45] Date of Patent: Apr. 26, 1988

[54] HAIR REPLACEMENT HAVING COLOR HIGHLIGHTS AND METHOD OF MAKING THE SAME

[75] Inventor: Charles W. Nelson, Mission, Kans.

[73] Assignee: Apollo Hair Systems, Inc., Mission, Kans.

[21] Appl. No.: 748,858

[22] Filed: Jun. 26, 1985

[51] Int. Cl.[4] ..... A41G 3/00

[52] U.S. Cl. ..... 132/53

[58] Field of Search ..... 132/53, 54, 5

[56] References Cited

U.S. PATENT DOCUMENTS

| | | | |
|---|---|---|---|
| 2,393,858 | 1/1946 | Gordon | 132/53 |
| 2,789,567 | 4/1957 | Jacoby | 132/53 |
| 2,865,380 | 12/1958 | Mitchell | 132/53 |
| 3,077,891 | 2/1963 | Lane | 132/5 |
| 3,165,107 | 1/1965 | Martin et al. | 132/53 |
| 3,411,235 | 11/1968 | Johnson | 132/5 |
| 3,460,546 | 8/1969 | Abbott | 132/53 |
| 3,474,767 | 10/1969 | Ito | 132/53 |
| 3,566,889 | 3/1971 | Cole et al. | 132/53 |
| 3,614,843 | 10/1971 | Hawtin et al. | 132/53 |
| 3,678,942 | 7/1972 | Abbott et al. | 132/5 |
| 3,809,100 | 5/1974 | Megna | 132/53 |
| 3,812,867 | 5/1974 | Wanderman et al. | 132/53 |
| 3,868,959 | 3/1975 | Koh | 132/53 |
| 3,968,807 | 7/1976 | Kraicer | 132/53 |
| 4,205,693 | 6/1980 | Mallouf | 132/53 |

*Primary Examiner*—Robert Peshock
*Assistant Examiner*—Cary E. Stone
*Attorney, Agent, or Firm*—Hovey, Williams, Timmons & Collins

[57] ABSTRACT

A hair replacement for use on a human head is comprised of a plurality of hairs that are connected to a flexible sheet-like base member. Certain of the hairs are shorter in length than other hairs, and the hairs are also of preselected, contrasting colors. The hairs on the hair replacement are arranged to show a gradation in color as well as length. As a result, the different lengths of the hair render all of the colors visible, whereby a streaked or sun-bleached effect may be realistically provided. In preferred forms, the hairs are arranged in tufts located at spaced intervals along the base member, and the average length of the tuft increases as the rear of the hair replacement is approached.

3 Claims, 1 Drawing Sheet

HAIR REPLACEMENT HAVING COLOR HIGHLIGHTS AND METHOD OF MAKING THE SAME

BACKGROUND OF THE INVENTION

1. Field of the Invention

This invention relates to improvements in the construction of hair replacements wherein hairs of different colors and dissimilar lengths are preselected to provide a streaked or sun-bleached effect.

2. Description of the Prior Art

The head has long been considered to be the noblest part of the human body because the head includes the brain, eyes and ears as well as the nose and mouth. Consequently, adornment of the head with a hair replacement is a practice that dates from prehistoric times.

In accordance with hair styles of recent years, an increasing amount of attention has been directed toward hair replacement construction wherein the individual hairs or filaments are of dissimilar lengths. By preselecting the hair lengths before assembling the hair replacement, the stylist need not cut and trim the hair replacement after it is secured to the head, whereby a considerable savings of time is realized both by the hairdresser as well as the customer. Furthermore, if the hair is erroneously cut or excessively trimmed the error can be corrected before the hair replacement is installed.

One of the primary objectives of modern hair replacements is to ensure that no tell-tale evidence is apparent that would lead a casual observer to conclude that a hair replacement is worn. For example, in a man's toupee for covering a central, upper bald area, the hairs or filaments in the toupee should conform in color to the natural hairs that are not obstructed by hair replacement. Likewise, a wig that is intended to cover the entire head should have a coloring that accurately represents hair shading under natural conditions.

Unfortunately, hair replacements constructed to date have not been able to satisfactorily duplicate the "streaked" or "sun-bleached" effect which often occurs in natural hair. As is known, the ultraviolet rays of the sun can lighten individual hairs such that a "highlighted" contrast of colors is effected between the bleached hairs and the remaining, darker hairs. However, attempts to create this streaked effect in a hair replacement have been largely unsuccessful.

SUMMARY OF THE INVENTION

The present invention significantly advances the art of hair replacement construction by utilization of a novel method which yields a hair replacement that accurately resembles natural, sun-bleached hair. The hair replacement can be manufactured and sold at a reasonable cost, yet the streaked effect is so realistic that the wearer is provided with a high order of security against detection.

In more detail, the hair replacement is comprised of a plurality of tufts which are coupled to a porous, flexible, sheet-like base member. Each tuft is comprised of a plurality of hairs and certain of the latter are of contrasting colors and of dissimilar lengths. Additionally, the average length of the tuft is increased as a rear portion of the hair replacement is approached.

The novel combination of hairs of different lengths as well as color shades allows the contrasting hues to show. Moreover, the hairs are preselected in preferred forms of the invention such that a realistic, progressive gradation in color as well as length is provided from the front to the back of the hair replacement. The fact that the lengths of the hairs are dissimilar allows the lighter colors as well as the darker colors to become apparent; such a shading or tonal contrast would not be visible if the individual hairs were of the same length.

As a result, the hair replacement of the instant invention closely resembles a streaked, frosted or highlighted effect to a degree heretofore unknown in the art. Such color accuracy is highly desirable in toupee utilization wherein a portion of the user's natural hair is revealed adjacent the perimeter of the hair replacement and natural hairs have been partially bleached by the sun or other means.

and

Figure 3:
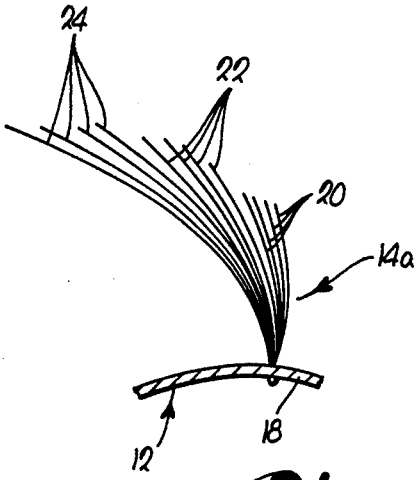
FIG. 3 is an enlarged, fragmentary, sectional view of a front portion of the hair replacement as shown in FIG. 2 wherein the individual hairs of one of the tufts are illustrated.
Figure 4:
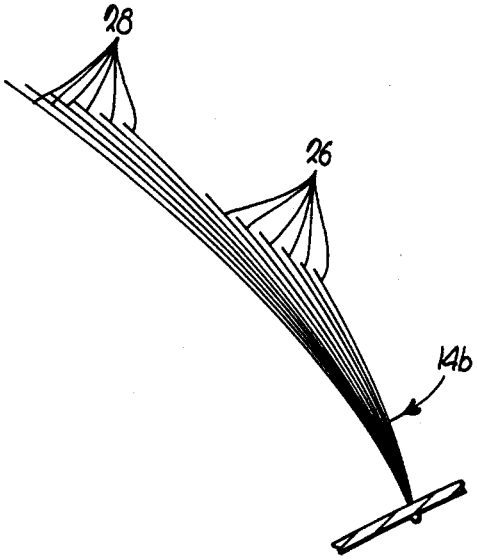

FIG. 4 is a view similar to FIG. 3 but showing a different tuft as at a back portion of the hair replacement.

DETAILED DESCRIPTION OF THE DRAWINGS

Figure 1:
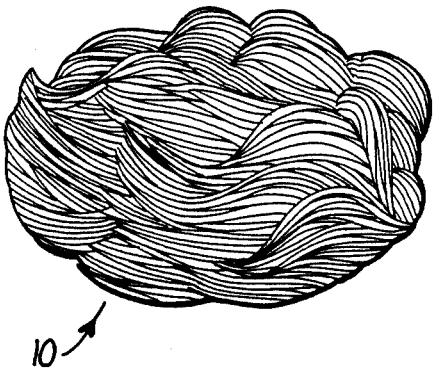
FIG. 1 is a perspective view of the hair replacement made in accordance with the instant invention.
Figure 2:
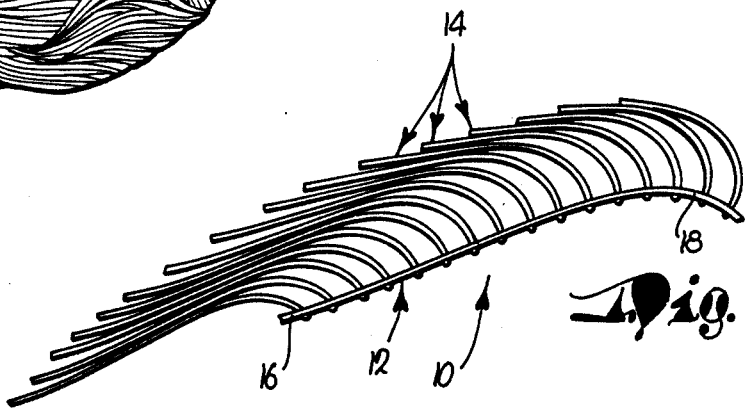
FIG. 2 is an enlarged, fragmentary, side sectional view of the hair replacement shown in FIG. 1, wherein the tufts are schematically depicted.

A hair replacement for use on a human head is designated broadly by the numeral 10 as is shown in FIG. 1. Viewing FIG. 2, the hair replacement 10 has a flexible, sheet-like base member 12 which advantageously is porous to allow air circulation to the underlying skin when worn. The hair replacement 10 may be affixed to the head according to the methods taught in U.S. Pat. Nos. 3,970,092, 4,254,784, 4,372,330 or, alternatively, by other means as desired.

A plurality of elongated tufts 14 are coupled to the base member 12 at spaced intervals throughout the area of the latter. As depicted schematically in FIG. 2, the tufts gradually increase in average length as a rear portion 16 of the base member 12 is approached.

Referring to FIG. 3, a tuft **14*a* disposed at a front portion 18 of the base member 12 is shown. The tuft 14*a* is comprised of a plurality of hairs 20–24 of preselected, contrasting colors, and the length of the hairs 20 is shorter than the hairs 22, while the hairs 24 are somewhat longer than the hairs 22. The "average" length of the tuft 14*a* may be computed by any desired method, such as a simple arithmetic sum of the length of the hairs 20–24** divided by the quantity of the same.

In FIG. 4, a tuft **14*b* is illustrated that preferably is positioned in the rear portion 16 of the base member 12. The tuft 14*b* comprises a plurality of relatively short hairs 26 of a certain, preselected color and a second plurality of hairs 28 that are relatively longer than the hairs 26. The hairs 28 also have a color which is in tonal contrast to the color of the hairs 26. Again, an average length of the tuft 14*b* may be computed by averaging the lengths of the hairs 26, 28. Comparing FIGS. 3 and 4, it will be obvious that the average length of the tuft 14*a* is shorter than the average length of the tuft 14*b***.

The hairs 22–28 on the hair replacement 10 are arranged to show a gradation in color as well as length. Such a dual gradation allows both the darker and lighter colors to be revealed so that a naturally streaked or sun-bleached effect is provided. Noteworthy is the fact that each of the individual hairs 22–28 are uniform in color throughout the length of each individual hair and that the tonal contrast is provided by the fact that the relatively longer hairs are only partially covered by the shorter hairs. Furthermore, as the hair replacement 10 is worn and the individual hairs 20, 28 are tousled, a variety of highlights or color contrasts are produced by movement and subsequent positioning of the various hairs so that a completely natural, realistic effect is achieved.

It is to be understood that the hairs 20–28 may be selected from human hair or, alternatively, may be of a manufactured, filamentous material. Accordingly, the instant invention should be considered to encompass all mechanical equivalents as those skilled in the art may recognize, and the scope of the invention should be limited only by a fair interpretation of the claims which follow.

I claim:

1. A hair replacement comprising:

a unitary base member of flexible sheet material adapted to be worn over a human head; and a plurality of tufts permanently coupled to said unitary base member, said tufts each comprising at least a first grouping of hairs of a certain, average length and a second grouping of hairs having an average length different than said certain length, the hairs of said first grouping and the hairs of said second grouping each having a substantially uniform color throughout their respective lengths with the color of the hairs of said first grouping being contrasting and different than the color of the hairs of said second grouping within the same tuft.

2. The invention of claim 1, wherein a front portion of said hair replacement has tufts with average hair lengths shorter than the average hair lengths of tufts in a rear portion of said hair replacement.

3. The invention of claim 1, wherein said tufts have average hair lengths that gradually increase in dimension as the rear of said hair replacement is approached.

* * * * *